United States Patent [19]

Adams

[11] 4,123,813

[45] Nov. 7, 1978

[54] BUOYANT FLOAT AND FLAG ASSEMBLY

[76] Inventor: Ronald J. Adams, 12311 Kent Ct., Southgate, Mich. 48195

[21] Appl. No.: 761,629

[22] Filed: Jan. 24, 1977

[51] Int. Cl.[2] ..... B63B 21/52

[52] U.S. Cl. ..... 9/8 R; 114/326; 116/173

[58] Field of Search ..... 116/173, 174, 175; 40/218; 9/8 R, 8.3 R, 8.3 E, 9; 114/16.5, 68; 403/329

[56] References Cited

U.S. PATENT DOCUMENTS

| | | | |
|---|---|---|---|
| 2,072,573 | 3/1937 | Vigliotti | 116/173 |
| 2,284,209 | 5/1942 | Holm | 40/218 |
| 2,324,983 | 7/1943 | Gollings | 9/8 E |
| 2,367,818 | 1/1945 | Diehl | 9/8.3 R |
| 2,409,076 | 10/1946 | Steinberger | 116/173 |
| 2,455,765 | 12/1948 | Harvey | 403/329 |
| 2,917,755 | 12/1959 | Peck | 9/8 E |
| 3,760,441 | 9/1973 | Handelman | 9/8 R |
| 3,828,380 | 8/1974 | Lebovits | 9/8 R |

*Primary Examiner*—Trygve M. Blix
*Assistant Examiner*—D. W. Keen
*Attorney, Agent, or Firm*—Basile and Weintraub

[57] ABSTRACT

A float and flag assembly for use by divers includes a buoyant annular ring or member mounted on an elongated staff. A flag or signalling device is mounted on the staff at one end thereof. A lead weight or the like is secured to the other end of the post.

10 Claims, 5 Drawing Figures

BUOYANT FLOAT AND FLAG ASSEMBLY

BACKGROUND OF THE INVENTION

1. Field of the Invention

The present invention pertains to aquatic buoyancy devices. More particularly, the present invention pertains to floating devices. Even more particularly, the present invention pertains to buoyant float and flag devices for use by divers.

2. Prior Art

There has been an ever-increasing growth in aquatic recreational activities. This is especially true with respect to people involved in Self-contained Underwater Breathing Apparatus (scuba) diving activities. Scuba diving is one of the fastest growing recreational activities. To accommodate the emergence of this sport there has been developed an assemblage of accoutrements and accessories, such as underwater lights, spear guns, travel bags and the like.

One of the more necessary accessories is a flotation device to enable the driver to rest upon the water, and which, also, signals to other people the presence of the diver in the water. Indeed, many states have enacted statutes requiring the use of flags or other signalling devices by divers. Heretofore, however, such flotation devices were cumbersome in that they were difficult to assembly and transport. Generally, such prior art systems require inflation devices, elongated posts, inner tubes and the like. More importantly, the floating member, which functions as a resting spot for the diver, ordinarily, fails to maintain a horizontal plane upon the water. Furthermore, the prior art flotation devices have to be dragged through the water, rather than be pulled across the surface.

The present invention, as will subsequently be detailed, overcomes these deficiencies in the prior art.

SUMMARY OF THE INVENTION

In accordance with the present invention there is provided a flotation device for use by underwater divers. The device hereof comprises an elongated post or staff which has an inflatable buoyant annular member mounted thereonto. In one embodiment, flexible bodies or grommets are journalled onto the staff and have the annular member secured thereto.

In another embodiment of the invention, a cylindrical member is journalled on the shaft. An inflatable buoyant member is secured to the member.

The staff utilized herein comprises separable telescoping sections, one section of which carries the buoyant member and the mounting means. Another section carries a visually observable flag or signalling device.

The present invention, also, provides a weight secured to the staff to maintain its vertical position.

For a more complete understanding of the present invention reference is made to the following detailed description and accompanying drawing. In the drawing, like reference characters refer to like parts throughout the several views, in which:

DESCRIPTION OF THE PREFERRED EMBODIMENT

Figure 1:
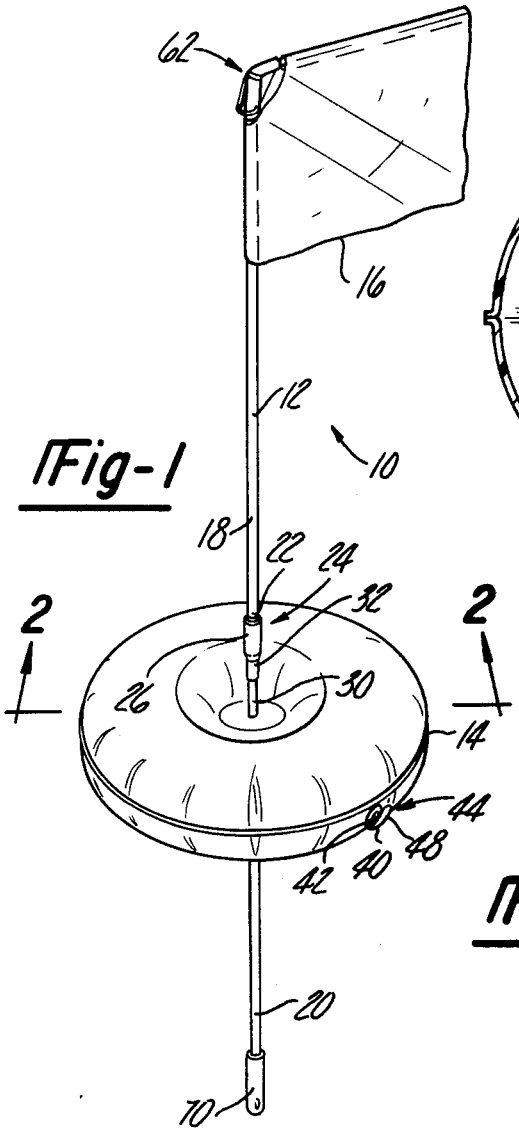
FIG. 1 is a perspective view of a first embodiment of the present invention.

Now, with reference to the drawing and, in particular, FIGS. 1, 2, 3 and 4 there is depicted therein a first embodiment of the present invention. The present float generally, denoted at 10, comprises an elongated staff or post 12, an annular inflatable buoyant member 14 and a visually observable flag or signalling device 16.

Figure 4:
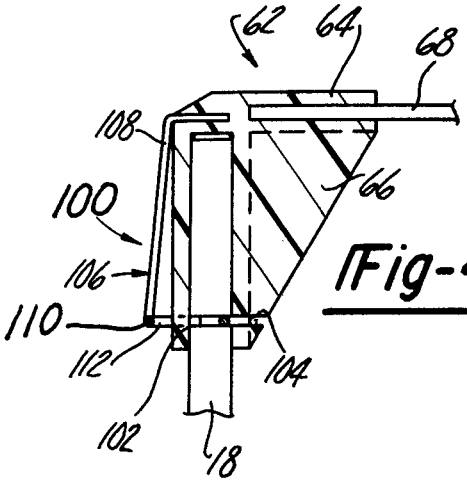
FIG. 4 is a broken, side elevational view of the staff.

With more particlarity, and as shown in FIGS. 1 and 4, the elongated staff comprises separable upper and lower sections 18 and 20, respectively. The upper and lower sections 18, 20 have a telescoping relationship. This is achieved by a reducer diameter section 22 accorded the lower terminus of the upper section. Alternatively, the upper section 18 can be provided with a smaller diameter than the lower section 20.

The telescoping sections are interlocked by means, generally, indicated at 24. The means 24 comprises a cap 26 journalled on the end 22 of the upper section 18. The cap 26 is provided with a plurality of projections (not shown) radiating outwardly therefrom. The projections are circumferentially disposed about the periphery of the cap 26.

The upper end 30 of the lower section 20 has a collar 32 secured thereto. The collar 32 is a hollow member having an inner diameter substantially equal to the diameter of the cap 26. The collar 32 has a plurality of projections (not shown) radiating outwardly therefrom. The projections are formed by recesses defined in the interior of the collar 32. These recesses are complementary to the projections of the cap 26 such that the projections are snappingly received therewithin. Thus, the projections of the cap are snappingly received by the recesses to separably interlock the upper and lower sections. Alternatively, an inner peripheral groove could be formed in the interior wall of the collar to receive the projections. It is to be appreciated that the cooperation between the projections and recesses define a detent for detachably interlocking the two telescoping sections 18, 20 of the staff 12.

It is to be further, understood that other modes can be utilized to render the sections telescopable. For example, a frictional fit between the reduced section 22 and the upper end 30 of the lower section 20 can be utilized. Such modes of detachably interlocking the section 18, 20 are within the ambit hereof.

Figure 2:
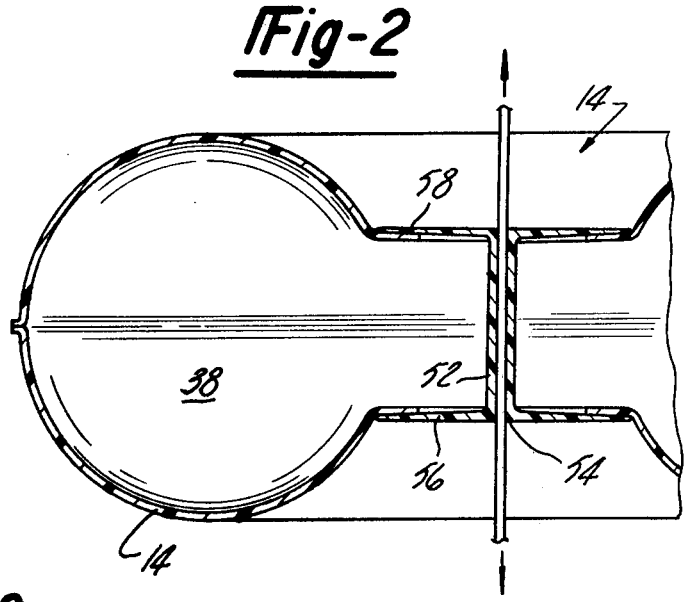
FIG. 2 is a broken cross-sectional view of the body used to mount the annular member used herein; and taken along line 2—2 of FIG. 1.

Referring again, in the drawing, and, specifically to FIGS. 1 and 2, as previously noted an annular buoyant member 14 is mounted on the staff 12. The member 14 is mounted onto the staff 12 by mounting means 36 described subsequently. The annular member 14, per se, comprises a thin-walled member having a hollow or open interior 38. Because of the environment in which the member is utilized, the member is formed from a substantially non-porous synthetic resinous material, such as vinyl, nylon backed polyurethane and the like. Preferably, the annular member is formed from a pin hole free ultraviolet light stabilized vinyl. Such material has a light enough density to float upon the surface of the water.

In accordance herewith, the annular member 14 is an inflatable member. The member 14 is rendered inflatably by an oral inflator 40 (FIG. 1). The inflator 40 comprises a valve stem 42 through which air is orally administered into the interior 38 of the member 14. The stem 42 comprises a hollow conduit having one end open to the atmosphere. The other end has its periphery dielectrically sealed to the thin wall of the member 14 and opens into communication with the interior 38.

In order to seal off the stem 42 a cap 44 is provided. The cap 44 comprises an elongated tube (not shown), which telescopes into the stem 42 and frictionally engages the inner wall thereof in the known manner, and a seal 48 integrally formed with the tube and which closes off the free end thereof. Thus, by inserting the tube into the stem 42, the interior is sealed after inflation. A connection can be extended from the seal 48 to the exterior periphery of the annular member to avoid the loss of the seal. When inflated, the annular member conveniently defines a resting place for a diver or swimmer.

In mounting the annular member 14 to the mounting means 36, the interior periphery of the annulus is dielectrically sealed to the mounting means at the points of contiguity therebetween. The mounting means 36 which is a spool shaped cylindrical member comprises a central member 52 having an internal passageway 54 formed therethrough along the extent thereof. The passageway 54 is dimensioned to have a slightly smaller diameter than the staff 12. By forming the spool from a flexible material, such as polyvinyl chloride, the member can be slid and fixed along the staff to its desired position. Furthermore, the means 36 is frictionally retained on the staff at the desired position.

Grommets 56, 58 are provided at each end of the member 52 and are integrally formed therewith. The grommets are, also, formed from the same material as the member and have the contiguous points of the peripheral wall of the member 14 dielectrically sealed thereto. The passageway 54 extends through the grommets. As shown in the drawing, the grommets are opposed, parallel and analogous. Each grommet has a diameter greater than the diameter of the member to fully protect the central opening of the annular member. The means 36, by virtue of its construction, from the flexible material and its dielectric sealing to the member 14 functions such that the grommets flex outwardly upon inflation of the annular member 14. Upon inflating the annular member, the air pressure exerted thereby upon the wall thereof and the contiguous surface of the grommet sealed thereto causes the outward flexure of the grommets.

This orientation of the grommets, i.e., the outward flexure, in cooperation with the buoyancy of the annular member causes the annular member to remain horizontal upon the surface of the water. This, in turn, causes the staff to remain substantially perpendicular with respect to the water.

Figure 3:
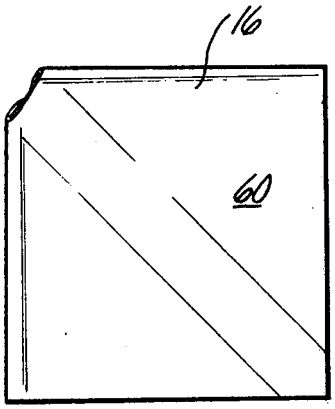
FIG. 3 is a side elevational view of the visually observable flag.

Referring, now to FIGS. 1, 3 and 4, and as hereinbefore noted, the present invention, also, comprises a visually observable flag or signalling device 16. The signalling device provides a signal for indicating that there is an underwater diver or swimmer in the vicinity of the float. This avoids any potential hazardous encounters with boats or the like by indicating to such vessels that there is a swimmer or diver in the vicinity. The flag 16 comprises a visually observable sheeting material 60 and a means, generally denoted at 62, for mounting the flag 16 onto the staff 12.

The means 62 comprises a right angled conduit 64. The conduit 64 has an interior diameter slightly larger than the diameter of the upper section 18 of the staff 12. This enables one leg of the conduit to be conveniently slid onto, in telescoping relationship, the upper section. In this manner, the flag is disposed at the top of the flag.

A reinforcing web 66 extends between the two legs of the conduit to reinforce the structure. It should be noted with respect hereto, that the leg of the conduit that telescope onto the staff is elongated with respect to the other leg. Thus, the leg is securely disposed onto the staff by virtue of the length of the leg.

The other leg of the conduit 64 has a rod 68 projecting outwardly therefrom. The rod 68 is parallel to the longitudinal axis of the conduit, as shown. The rod 68 is integrally formed with the wall of the conduit 64.

In securing the sheeting material to the means 62 the material, per se, is folded over, upon either the rod 68 or the extended conduit leg, such that a portion of the material backs itself. The double-over portion of the material can then be stitched to itself to securely attach the material to the mounting means at 62.

Referring to FIG. 4, there is depicted therein means 100 for locking the observation means to the staff. In accordance herewith the staff section 18 has a peripheral groove or notch 102 formed therein. The groove or notch 102 is adapted to be in registry with a notch 104 formed in the conduit 64, such that when the conduit 64 is positioned on the staff section 18, the notch 104 overlies the notch 102.

A biassed pin assembly 106 has one leg 108 thereof secured to the conduit 64 by any suitable mode. The other end 110 of the assembly 106 carries a circular pin 112. The circular pin 112 nests in the overlying and coincident notches 102, 104, in normal position. By forming the assembly 106 from spring wire or the like, the pin 112 is normally biassed into the notches. To release the pin 112, the assembly 106 is manually pressed against its bias to urge the pin 112 out of the notches to permit disengagement of the conduit 64 from the staff section 18.

In order to keep the staff 12 stabilized in the water a lead weight 70 is secured to the lower end of the staff 12, as shown (FIG. 1). Any suitable means, such as threaded fasteners, can be utilized to secure the weight of the staff.

Figure 5:
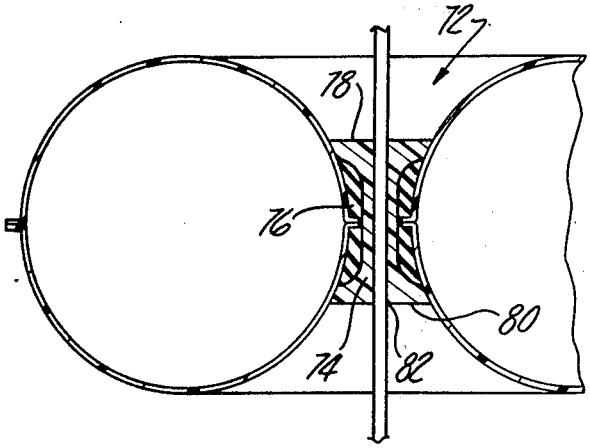
FIG. 5 is a cross-sectional view of an alternate form of body.

Referring, now, to FIG. 5 there is depicted therein an alternate mode for mounting the annular member to the staff. In all other respects this embodiment of the invention is the same as heretofore described. Thus, for purposes of clarity and brevity, the following discussion will concern solely the mounting means for the annular member.

The mounting means, generally, denoted at 72 comprises a substantially cylindrical member 74 having a recessed sidewall 76. The member 74, also, comprises a planar top wall 78 and a planar bottom wall 80. A central interior passageway 82 is formed in the member and extends from through the top wall and bottom wall. The annular member 14 is dielectrically sealed to the exterior of the member or body 74 in the same manner heretofore described. The body 74 is formed from a flexible polyvinyl chloride. Furthermore, the diameter of the passageway 82 is undersized, in the same manner, also, heretofore described.

It should further be noted that the annular member and cylindrical member can be formed as an integral unit by either slush molding or roto casting the annular member and cylindrical member. It is, also, possible in accordance herewith to provide a cylindrical member having a larger diameter than the staff section. Locking of the annular member is then achieved by utilizing grommets which are frictionally emplaced on the staff with an undersized central aperture. Because the grommets are frictionally fit on the staff, movement of the annular member and spool would be virtually impossible since they would be held between the grommets.

In fabricating the present invention any suitable materials can be utilized. For example, the staff 12 and the rod 68 can be formed from fiberglass and the conduit 64 from polypropylene. The sheeting material 60 is, preferably, a vinyl sheet.

It is to be appreciated that there has been described herein an improved flag and float device for use by under- water swimmers and divers which is easily transported and which can be pulled on, rather than dragged, through the water.

Having, thus, described the invention, what is claimed is:

1. A flotation device, comprising:
(a) an elongated staff,
(b) an annular buoyant member,
(c) means for mounting the buoyant member to the staff, comprising: (a) a cylindrical body having a recessed sidewall, a planar top wall and a planar bottom wall, the body being provided with an internal passageway having a diameter less than that of the staff such that the body is frictionally retained on the staff.
(d) a visually observable signalling device detachably mounted onto the staff at one end thereof, and
(e) means for detachably locking the visually observable signalling device onto the staff, the locking means, comprising:
(1) a biassed member secured to the visually observable device, and
(2) means for receiving the biassed member formed on the staff, the receiving means releasably retaining the biassed member upon the mounting of the device to the staff.

2. The device of claim 1 wherein:
(a) the biassed member comprises a spring circular pin secured to the observable device, and
(b) the receiving means is defined by an annular groove formed in the snap, the pin being biassed into the groove upon the mounting of the observable device onto the staff.

3. The flotation device of claim 1 wherein the visually observable signalling device comprises:
(a) means for mounting the signalling device onto the staff, the means comprising:
(1) a right angle conduit having a first elongated leg and a second leg,
(2) the elongated leg being telescopable onto the staff,
(3) a rod projecting outwardly from the second leg, and
(b) a visually observable sheet material secured to the means for mounting.

4. The flotation device of claim 1 wherein:
the annular member is formed from an ultraviolet light stabilized vinyl material.

5. The flotation device of claim 1 wherein the annular member is dielectrically sealed to the means for mounting, said means being in the shape of a spool, the top and bottom walls thereof comprising flexible grommets, said passageway extending through each grommet.

6. The flotation device of claim 5 wherein:
the annular member is an inflatable member, the annular member comprising means for orally inflating the member, and
wherein upon inflating the member the grommets flex outwardly away from toward each other.

7. The flotation device of claim 1 wherein:
the staff comprises:
(a) a pair of detachably connectable telescoping sections, and
(b) means for detachably interconnecting the sections together.

8. The flotation device of claim 1, wherein:
the annular member is inflatable, the annular member comprising means for orally inflating the member.

9. The flotation device of claim 1 which further comprises:
a weight disposed at one end of the staff.

10. A flotation device, comprising:
(a) an elongated staff,
(b) an annular buoyant member,
(c) means for mounting the buoyant member to the staff, comprising: a cylindrical body having a recessed sidewall, a planar top wall and a planar bottom wall, the body being provided with an internal passageway having a diameter less than that of the staff such that the body is frictionally retained on the staff,
(d) a visually observable signalling device detachably mounted onto the staff at one end thereof, and
(e) means for detachably locking the visually observable signalling device onto the staff.

* * * * *